US010203622B2

(12) United States Patent
Okita

(10) Patent No.: US 10,203,622 B2
(45) Date of Patent: Feb. 12, 2019

(54) ELECTROSTATIC LATENT IMAGE DEVELOPING TONER

(71) Applicant: KYOCERA Document Solutions Inc., Osaka (JP)

(72) Inventor: Masaki Okita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/873,139

(22) Filed: Jan. 17, 2018

(65) Prior Publication Data

US 2018/0203371 A1 Jul. 19, 2018

(30) Foreign Application Priority Data

Jan. 19, 2017 (JP) ..... 2017-007597

(51) Int. Cl.
*G03G 9/087* (2006.01)
*G03G 9/09* (2006.01)
*G03G 9/08* (2006.01)

(52) U.S. Cl.
CPC ..... *G03G 9/08797* (2013.01); *G03G 9/0821* (2013.01); *G03G 9/08711* (2013.01); *G03G 9/08755* (2013.01); *G03G 9/08782* (2013.01); *G03G 9/08786* (2013.01); *G03G 9/08791* (2013.01); *G03G 9/08795* (2013.01); *G03G 9/09* (2013.01)

(58) Field of Classification Search
CPC ..... G03G 9/08795; G03G 9/08784; G03G 9/08797; G03G 9/08788; G03G 9/08791; G03G 9/08755; G03G 9/08711; G03G 9/0821; G03G 9/08786; G03G 9/08782
USPC ..... 430/109.4, 109.3, 109.2
See application file for complete search history.

(56) References Cited

U.S. PATENT DOCUMENTS 8,679,717 B2 * 3/2014 Matsuoka ..... G03G 9/0874 430/109.1

FOREIGN PATENT DOCUMENTS

JP 2016-53677 A 4/2016

* cited by examiner

*Primary Examiner* — Janis L Dote
(74) *Attorney, Agent, or Firm* — Studebaker & Brackett PC

(57) ABSTRACT

Toner particles contain a non-crystalline polyester resin, a crystalline polyester resin, a styrene-acrylic acid-based resin, and a releasing agent. An amount of the releasing agent contained in the toner is at least 7.5% by mass and no greater than 12.5% by mass. An amount of the styrene-acrylic acid-based resin contained in the toner is at least 50 parts by mass and no greater than 100 parts by mass relative to 100 parts by mass of the releasing agent. The crystalline polyester resin includes an acrylic acid-based unit and a styrene-based unit. The styrene-acrylic acid-based resin includes an acrylic acid-based unit that has an epoxy group and a styrene-based unit. A peak top molecular weight of the toner in a differential molecular weight distribution curve is at least 8,000 and no greater than 12,000. A mass average molecular weight of the toner is at least 40,000 and no greater than 65,000.

10 Claims, 1 Drawing Sheet

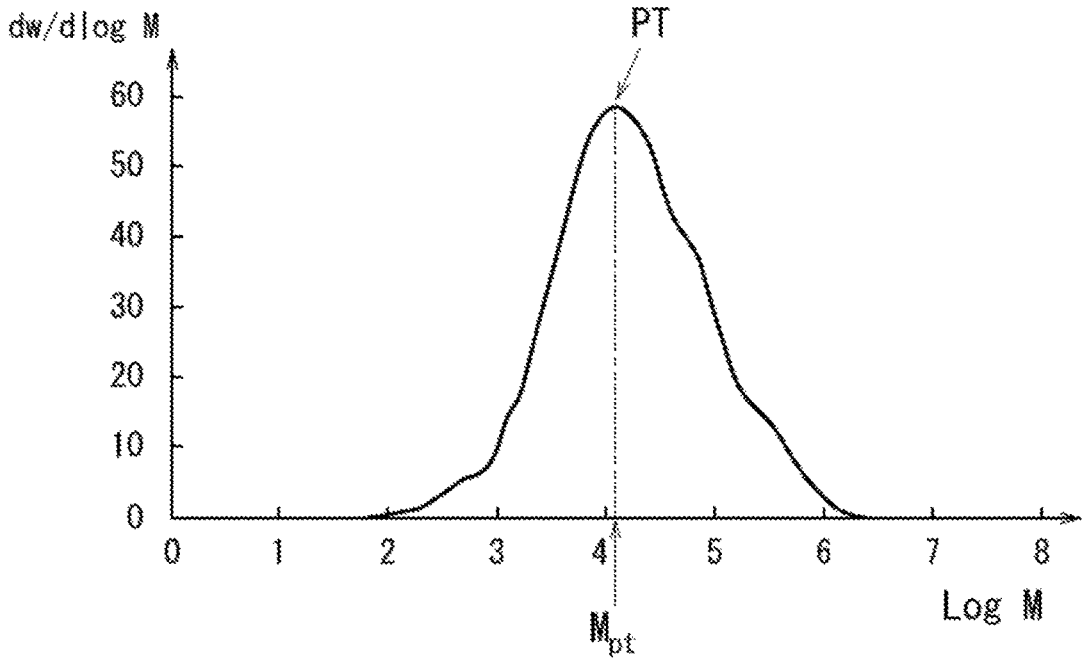
dw/dlog M
PT
60
50
40
30
20
10
0
0
1
2
3
4
5
6
7
8
Log M
Mpt

ELECTROSTATIC LATENT IMAGE DEVELOPING TONER

INCORPORATION BY REFERENCE

The present application claims priority under 35 U.S.C. § 119 to Japanese Patent Application No. 2017-007597, filed on Jan. 19, 2017. The contents of this application are incorporated herein by reference in their entirety.

BACKGROUND

The present disclosure relates to an electrostatic latent image developing toner.

As a technique regarding electrostatic latent image developing toners, there is known a technique for making toner particles contain a polyester resin, a styrene-acrylic acid resin, a colorant, and a releasing agent.

SUMMARY

An electrostatic latent image developing toner according to the present disclosure includes a plurality of toner particles each containing a non-crystalline polyester resin, a crystalline polyester resin, a styrene-acrylic acid-based resin, and a releasing agent. An amount of the releasing agent contained in the toner is at least 7.5% by mass and no greater than 12.5% by mass. An amount of the styrene-acrylic acid-based resin contained in the toner is at least 50 parts by mass and no greater than 100 parts by mass relative to 100 parts by mass of the releasing agent. The crystalline polyester resin includes a first repeating unit derived from an acrylic acid-based monomer and a second repeating unit derived from a styrene-based monomer. The styrene-acrylic acid-based resin includes a third repeating unit derived from an acrylic acid-based monomer that has an epoxy group and a fourth repeating unit derived from a styrene-based monomer. A peak top molecular weight of the toner in a differential molecular weight distribution curve obtained by GPC measurement is at least 8,000 and no greater than 12,000. A mass average molecular weight of the toner determined by the GPC measurement is at least 40,000 and no greater than 65,000.

BRIEF DESCRIPTION OF THE DRAWINGS

FIGURE illustrates an example of a differential molecular weight distribution curve.

DETAILED DESCRIPTION

The following describes an embodiment of the present disclosure. Evaluation results (for example, values indicating shape and physical properties) for a powder (specific examples include toner mother particles, an external additive, and a toner) are each a number average of values measured for a suitable number of representative particles of the powder, unless otherwise stated.

A number average primary particle diameter of a powder is a number average value of equivalent circle diameters of primary particles (i.e., Heywood diameters: diameters of circles having the same areas as projections of the particles) measured using a microscope, unless otherwise stated. A measured value for the volume median diameter ($D_{50}$) of a powder is a value measured using a laser diffraction/scattering particle size distribution analyzer ("LA-750" manufactured by HORIBA, Ltd.), unless otherwise stated. Measured values for the acid value and the hydroxyl value are values measured in accordance with "Japanese Industrial Standard (JIS) K0070-1992", unless otherwise stated. Measured values for the number average molecular weight (Mn) and the mass average molecular weight (Mw) are values measured using gel permeation chromatography, unless otherwise stated.

A glass transition point (Tg) is a value measured in accordance with "Japanese Industrial Standard (JIS) K7121-2012" using a differential scanning calorimeter ("DSC-6220" manufactured by Seiko Instruments Inc.), unless otherwise stated. On a heat absorption curve (vertical axis: heat flow (DSC signal), horizontal axis: temperature) measured using the differential scanning calorimeter in a second temperature increase, a temperature (an onset temperature) at an inflection point (an intersection point of an extrapolation line of a base line and an extrapolation line of an inclined portion of the curve) due to glass transition corresponds to the glass transition point (Tg). A softening point (Tm) is a value measured using a capillary rheometer ("CFT-500D" manufactured by Shimadzu Corporation), unless otherwise stated. On an S-shaped curve (horizontal axis: temperature, vertical axis: stroke) measured using the capillary rheometer, a temperature at which the stroke value is "(base line stroke value+maximum stroke value)/2" corresponds to the softening point (Tm). A measured value for the melting point (Mp) is a temperature at a peak indicating maximum heat absorption on a heat absorption curve (vertical axis: heat flow (DSC signal), horizontal axis: temperature) measured using the differential scanning calorimeter ("DSC-6220" manufactured by Seiko Instruments Inc.), unless otherwise stated.

Chargeability means chargeability in triboelectric charging, unless otherwise stated. Strength of a tendency to be positively charged (or strength of a tendency to be negatively charged) in triboelectric charging can be known from a known triboelectric series or the like.

A solubility parameter (SP) value is a value (unit: $(cal/cm^3)^{1/2}$, temperature: 25° C.) calculated in accordance with the Fedors method (R. F. Fedors, "Polymer Engineering and Science", vol. 14, no. 2, pp. 147-154, 1974). The SP value is represented by an expression "SP value=$(E/V)^{1/2}$" (E: molecular cohesive energy [cal/mol], V: molecular volume [$cm^3$/mol]).

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl. Also, the term "(meth)acrylonitrile" is used as a generic term for both acrylonitrile and methacrylonitrile.

A toner according to the present embodiment can be suitably used for development of electrostatic latent images as a positively chargeable toner, for example. The toner of the present embodiment is a powder including a plurality of toner particles (particles each having features described further below). The toner may be used as a one-component developer. Alternatively, the toner may be mixed with a carrier using a mixer (for example, a ball mill) to prepare a two-component developer. In order to form high-quality images, a ferrite carrier (a powder of ferrite particles) is preferably used as the carrier. Also, in order to form high-quality images over a long period of time, magnetic carrier particles each including a carrier core and a resin layer covering the carrier core are preferably used. In order that the carrier is capable of sufficiently charging the toner over a long period of time, it is preferable that the resin layer completely covers a surface of the carrier core (that is, no surface region of the carrier core is exposed from the resin layer). In order to make carrier particles magnetic, carrier cores may be formed from a magnetic material (for example, a ferromagnetic substance such as ferrite), or the carrier cores may be formed from a resin in which magnetic particles are dispersed. Alternatively, the magnetic particles may be dispersed in the resin layer covering the carrier core. In order to form high-quality images, an amount of the toner in the two-component developer is preferably at least 5 parts by mass and no greater than 15 parts by mass relative to 100 parts by mass of the carrier. Note that a positively chargeable toner included in a two-component developer is positively charged by friction with a carrier.

The toner according to the present embodiment can be used for image formation using an electrophotographic apparatus (an image forming apparatus), for example. The following describes an example of image forming methods using the electrophotographic apparatus.

First, an image forming section (for example, a charger and a light exposure device) of the electrophotographic apparatus forms an electrostatic latent image on a photosensitive member (for example, a surface layer portion of a photosensitive drum) on the basis of image data. Subsequently, a developing device (specifically, a developing device loaded with a developer including a toner) of the electrophotographic apparatus supplies the toner to the photosensitive member to develop the electrostatic latent image formed on the photosensitive member. The toner is charged by friction with a carrier, a development sleeve, or a blade in the developing device before being supplied to the photosensitive member. For example, a positively chargeable toner is charged positively. In the developing process, the toner (specifically, the charged toner) on the development sleeve (for example, a surface layer portion of a development roller in the developing device) disposed in the vicinity of the photosensitive member is supplied to the photosensitive member to be attached to a part of the electrostatic latent image on the photosensitive member, which part is exposed to light. Through the above, a toner image is formed on the photosensitive member. The developing device is replenished with a toner for replenishment use in the same amount as the toner consumed in the developing process from a toner container.

In a subsequent transfer process, a transfer device of the electrophotographic apparatus transfers the toner image from the photosensitive member onto an intermediate transfer member (for example, a transfer belt), and then further transfers the toner image from the intermediate transfer member onto recording medium (for example, paper). Thereafter, the toner is fixed to the recording medium through application of heat and pressure thereto by a fixing device (fixing method: nip fixing performed by a heating roller and a pressure roller) of the electrophotographic apparatus. Through the above, an image is formed on the recording medium. For example, a full-color image can be formed by superposing toner images in respective four colors of black, yellow, magenta, and cyan. After the transfer process, the toner left on the photosensitive member is removed by a cleaning member (for example, a cleaning blade). Note that a direct transfer method by which the toner image is directly transferred from the photosensitive member to the recording medium not via the intermediate transfer member may be employed as the transfer method. Also, belt fixing may be employed as the fixing method.

The toner according to the present embodiment includes a plurality of toner particles. The toner particles may each include an external additive. In a configuration in which the toner particles each include an external additive, the toner particles each include a toner mother particle and the external additive. The external additive adheres to surfaces of the toner mother particles. The toner mother particles contain a binder resin. The toner mother particles may contain an internal additive (for example, at least one of a releasing agent, a colorant, a charge control agent, and a magnetic powder) in addition to the binder resin, as necessary. Note that the external additive may be omitted if unnecessary. In a configuration in which the external additive is omitted, the toner mother particles are equivalent to the toner particles.

The toner particles included in the toner according to the present embodiment may be toner particles (hereinafter referred to as non-capsule toner particles) each of which does not include a shell layer, or toner particles (hereinafter referred to as capsule toner particles) each including a shell layer. In the capsule toner particles, the toner mother particles each include a toner core and the shell layer formed on a surface of the toner core. The shell layer is substantially formed from a resin. For example, both heat-resistant preservability and low-temperature fixability of the toner can be achieved by covering a toner core that melts at low temperatures with a shell layer excellent in heat resistance. An additive may be dispersed in the resin forming the shell layer. The shell layer may cover the surface of the toner core entirely or partially. The shell layer may be substantially formed from a thermosetting resin or a thermoplastic resin. Alternatively, the shell layer may contain both a thermoplastic resin and a thermosetting resin.

The non-capsule toner particles can be produced by a pulverization method or an aggregation method, for example. Through these methods, internal additives tend to be sufficiently dispersed in the binder resin of the non-capsule toner particles. Typically, toners are largely classified into pulverized toners and polymerized toners (also called chemical toners). A toner obtained by the pulverization method belongs to the pulverized toners, and a toner obtained by the aggregation method belongs to the polymerized toners.

In an example of the pulverization method, the binder resin, the colorant, the charge control agent, and the releasing agent are initially mixed. Subsequently, the resultant mixture is melt-kneaded using a melt-kneading device (for example, a single-screw or twin-screw extruder). Subsequently, the resultant melt-kneaded product is pulverized, and the resultant pulverized product is classified. Through the above, the toner mother particles are obtained. In many cases, the toner mother particles can be produced more easily by the pulverization method than by the aggregation method.

In an example of the aggregation method, the binder resin, the releasing agent, the charge control agent, and the colorant each in the form of particulates are caused to aggregate in an aqueous medium to form particles of a desired particle diameter. Through the above, aggregated particles containing the binder resin, the releasing agent, the charge control agent, and the colorant are formed. Subsequently, the obtained aggregated particles are heated to cause to coalescence of the components contained in the aggregated particles. Through the above, the toner mother particles having a desired particle diameter are obtained.

In production of the capsule toner particles, the shell layer may be formed by any process. For example, the shell layer may be formed by any of an in-situ polymerization process, an in-liquid curing film coating process, and a coacervation process.

The toner according to the present embodiment is an electrostatic latent image developing toner having features (hereinafter referred to as basic features) described below.

(Basic Features of Toner)

The toner includes a plurality of toner particles each containing a non-crystalline polyester resin, a crystalline polyester resin, a styrene-acrylic acid-based resin, and a releasing agent. An amount of the releasing agent contained in the toner is at least 7.5% by mass and no greater than 12.5% by mass. An amount of the styrene-acrylic acid-based resin contained in the toner is at least 50 parts by mass and no greater than 100 parts by mass relative to 100 parts by mass of the releasing agent. The crystalline polyester resin includes a first repeating unit derived from an acrylic acid-based monomer and a second repeating unit derived from a styrene-based monomer. The styrene-acrylic acid-based resin includes a third repeating unit derived from an acrylic acid-based monomer that has an epoxy group and a fourth repeating unit derived from a styrene-based monomer. A peak top molecular weight of the toner in a differential molecular weight distribution curve (hereinafter referred to as GPC molecular weight distribution) obtained by gel permeation chromatography (GPC) measurement is at least 8,000 and no greater than 12,000. A mass average molecular weight (Mw) of the toner determined by the gel permeation chromatography (GPC) measurement is at least 40,000 and no greater than 65,000.

The first repeating unit and the third repeating unit may have the same chemical structure or different chemical structures from each other. The second repeating unit and the fourth repeating unit may have the same chemical structure or different chemical structures from each other.

The acrylic acid-based monomers and the styrene-based monomers are each a vinyl compound. The vinyl compound becomes a repeating unit constituting a resin by addition polymerization ("C═C"→"—C—C—") through a carbon-to-carbon double bond "C═C". The vinyl compound is a compound that has a vinyl group ($CH_2$═CH—) or a substituted vinyl group in which hydrogen is replaced. Examples of vinyl compounds include ethylene, propylene, butadiene, vinyl chloride, acrylic acid, acrylic acid esters, methacrylic acid, methacrylic acid esters, acrylonitrile, and styrene.

In the toner having the above-described basic features, the toner particles each contain the crystalline polyester resin and the non-crystalline polyester resin. The crystalline polyester resin contained in the toner particles imparts sharp meltability to the toner particles. As a result of imparting sharp meltability to the toner particles, it becomes easy to obtain a toner excellent in both heat-resistant preservability and low-temperature fixability. In order to improve releasability of the toner, the toner preferably contains a sufficient amount (for example, at least 7.5% by mass) of the releasing agent.

However, in a configuration in which the toner particles contain the crystalline polyester resin, elasticity of the toner tends to decrease. When elasticity of the toner decreases, hot offset is likely to occur and pulverizability of the toner tends to deteriorate. Also, in production of the pulverized toner (specifically, in the melt-kneading process), an increase in the amount of the releasing agent included in toner materials results in a decrease in viscosity of the toner materials and difficulty in kneading the toner materials by applying sufficient shear (shear stress). When the toner materials are not sufficiently kneaded, a dispersion diameter of the releasing agent increases and the releasing agent tends to be detached from the toner particles. The releasing agent tends to be detached from the toner particles in a configuration in which the amount of the releasing agent is excessively large or the dispersion diameter of the releasing agent is excessively large. When the releasing agent is detached from the toner particles, sufficient releasability of the toner is difficult to achieve. Also, the detached releasing agent may cause agglomeration of the toner during preservation, and fogging and contamination of the inside of the apparatus during image formation.

In the toner having the above-described basic features, the toner particles each contain the crystalline polyester resin, the non-crystalline polyester resin, the styrene-acrylic acid-based resin, and the releasing agent. Also, the toner having the above-described basic features contains the releasing agent in an amount of at least 7.5% by mass and no greater than 12.5% by mass. That is, at least 0.075 g and no greater than 0.125 g of the releasing agent is contained per 1 g of the toner. In the above-described basic features, sufficient low-temperature fixability of the toner is achieved since the toner particles contain the crystalline polyester resin. Also, sufficient releasability of the toner is achieved since the toner contains a sufficient amount of the releasing agent. Further, sufficient pulverizability of the toner is achieved and detachment of the releasing agent from the toner particles is prevented by other features as described below in detail.

In the toner having the above-described basic features, the toner particles each further contain the styrene-acrylic acid-based resin in addition to the crystalline polyester resin and the non-crystalline polyester resin. The present inventor found that pulverizability of the toner improves in a configuration in which the toner particles each contain the crystalline polyester resin, the non-crystalline polyester resin, and the styrene-acrylic acid-based resin. It is thought that the number of interfaces increases in the melt-kneaded product since the polyester resins and the styrene-acrylic acid-based resin tend not to be compatible with one another. The interfaces improve pulverizability of the melt-kneaded product. It is thought that in the pulverization process, the toner materials tend to separate from each other at the interfaces. Further, in a situation in which the releasing agent is dissolved in the styrene-acrylic acid-based resin, the releasing agent tends to be present at pulverization interfaces (corresponding to surfaces of the toner particles after the pulverization). The releasing agent present on the surfaces of the toner particles improves releasability of the toner. Detachment of the releasing agent from the toner particles can be prevented by compatibilizing the styrene-acrylic acid-based resin and the releasing agent until a diameter of a domain of the releasing agent becomes sufficiently small.

In the toner having the above-described basic features, the toner particles contain at least 50 parts by mass and no greater than 100 parts by mass of the styrene-acrylic acid-based resin (the binder resin) relative to 100 parts by mass of the releasing agent. In a configuration in which the amount of the styrene-acrylic acid-based resin is excessively large relative to the amount of the releasing agent, the diameter of the domain of the releasing agent becomes excessively small and the effect of improving releasability of the toner particles by the releasing agent (particularly, the domain of the releasing agent present on the surface of each toner particle) becomes insufficient. By contrast, in a configuration in which the amount of the styrene-acrylic acid-based resin is excessively small relative to the amount of the releasing agent, the diameter of the domain of the releasing agent becomes excessively large and the releasing agent (particularly, the domain of the releasing agent present on the surface of each toner particle) tends to be detached from the toner particles.

Typically, the crystalline polyester resin, the non-crystalline polyester resin, and the styrene-acrylic acid-based resin tend not to be compatible with one another. Therefore, in a situation in which these three types of resins are used as the binder resin of the toner particles, insufficient dispersion of toner components (internal additives) is likely to occur. In the toner having the above-described basic features, the crystalline polyester resin includes the first repeating unit derived from an acrylic acid-based monomer and the second repeating unit derived from a styrene-based monomer. Further, the styrene-acrylic acid-based resin includes the third repeating unit derived from an acrylic acid-based monomer that has an epoxy group and the fourth repeating unit derived from a styrene-based monomer. Preferable examples of the third repeating unit include a repeating unit derived from glycidyl methacrylate and represented by formula (1) shown below.

(1)

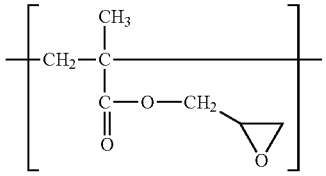

In a configuration in which both the crystalline polyester resin and the styrene-acrylic acid-based resin include styrene-acrylic acid-based units (the crystalline polyester resin: the first repeating unit and the second repeating unit, the styrene-acrylic acid-based resin: the third repeating unit and the fourth repeating unit), the crystalline polyester resin, the non-crystalline polyester resin, and the styrene-acrylic acid-based resin tend to be compatible with one another. Further, the present inventor found a region that tends to be compatible with the releasing agent is formed as a result of the epoxy group of the styrene-acrylic acid-based resin (for example, "Y" in formula (R) shown below) and a carboxyl group of the polyester resins (for example, "X" in formula (R)) chemically reacting with each other as represented by formula (R).

(R)

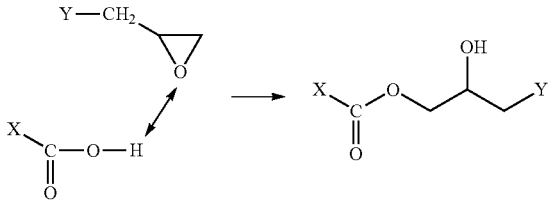

It is thought that in a situation in which the above-described region is formed, the releasing agent tends to be finely dispersed in the binder resin. Also, in a situation in which a chemical bond is formed as described above in the melt-kneaded product in production of the pulverized toner (specifically, in the melt-kneading process), it is possible to melt-knead the toner materials while keeping viscosity of the toner materials sufficiently high even when the toner materials including the crystalline polyester resin are melt-kneaded. Therefore, it becomes easy to melt-knead the toner materials including the crystalline polyester resin by applying sufficient shear (shear stress). Although equipment may be modified to apply strong shear (shear stress) to the toner materials, this is highly likely to cause deterioration of elasticity of the binder resin.

In order to increase reactivity among the non-crystalline polyester resin, the crystalline polyester resin, and the styrene-acrylic acid-based resin, it is preferable that the crystalline polyester resin includes, as the first repeating unit, a repeating unit derived from an acrylic acid-based monomer (specific examples include acrylic acid and methacrylic acid) that has a carboxyl group, and the styrene-acrylic acid-based resin further includes, in addition to the third repeating unit and the fourth repeating unit, a fifth repeating unit derived from an acrylic acid-based monomer (specific examples include acrylic acid and methacrylic acid) that has a carboxyl group. Also, in order that a sufficient number of chemical bonds between carboxyl groups of the non-crystalline polyester resin and epoxy groups of the styrene-acrylic acid-based resin is present in the binder resin, an acid value of the non-crystalline polyester resin is preferably at least 5 mgKOH/g, and more preferably at least 10 mgKOH/g. In a configuration in which the acid value of the non-crystalline polyester resin is excessively small, the number (number density) of the chemical bonds becomes excessively small and the releasing agent tends not to be sufficiently dispersed in the binder resin. In order to improve charge stability of the toner, the acid value of the non-crystalline polyester resin is preferably no greater than 30 mgKOH/g. In a configuration in which the acid value of the non-crystalline polyester resin is excessively large, hygroscopicity of the toner increases and it becomes difficult to achieve sufficient chargeability of the toner in an environment of high temperature and high humidity.

In order to disperse the crystalline polyester resin in the non-crystalline polyester resin appropriately, it is preferable that the non-crystalline polyester resin has an SP value of at least 12.0 $(cal/cm^3)^{1/2}$ and no greater than 13.0 $(cal/cm^3)^{1/2}$, and the crystalline polyester resin has an SP value of at least 10.0 $(cal/cm^3)^{1/2}$ and no greater than 10.6 $(cal/cm^3)^{1/2}$.

In the above-described basic features, the peak top molecular weight ($M_{pt}$) of the toner in the GPC molecular weight distribution (the differential molecular weight distribution curve) is at least 8,000 and no greater than 12,000, and the mass average molecular weight (Mw) of the toner is at least 40,000 and no greater than 65,000. In a configuration in which the peak top molecular weight of the toner is excessively large, the toner becomes excessively hard and pulverizability of the toner tends to deteriorate. In a configuration in which the peak top molecular weight of the toner is excessively small, low-temperature fixability of the toner tends to deteriorate. Also, in the configuration in which the peak top molecular weight of the toner is excessively small, adhesiveness of the toner becomes excessively strong and agglomeration of the toner during preservation, and fogging and contamination of the inside of the apparatus during image formation tend to occur. In a configuration in which the mass average molecular weight of the toner is excessively small, hot offset resistance of the toner tends to deteriorate. In a configuration in which the mass average molecular weight of the toner is excessively large, low-temperature fixability of the toner tends to deteriorate. Also, in the configuration in which the mass average molecular weight of the toner is excessively large, the resultant toner image tends not to be smooth and gloss of the resultant image tends to be insufficient.

FIGURE illustrates an example of the GPC molecular weight distribution (the differential molecular weight distribution curve). In the illustrated GPC molecular weight distribution, the horizontal axis represents a logarithmic value (Log M) of the molecular weight M, and the vertical axis represents a value (dw/d Log M) obtained by differentiating a density fraction w by the logarithmic value of the molecular weight M. In the illustrated GPC molecular weight distribution, the molecular weight $M_{pt}$ at the peak top PT is 11,000, and the mass average molecular weight (Mw) is 63,000.

Next, the following describes a configuration of non-capsule toner particles. Specifically, the following describes the toner mother particles (the binder resin and the internal additives) and the external additive in order. The toner mother particles of the non-capsule toner particles described below can be used as toner cores of capsule toner particles.

[Toner Mother Particles]

The toner mother particles each contain the binder resin. Also, the toner mother particles may each contain the internal additives (for example, the colorant, the releasing agent, the charge control agent, and the magnetic powder).

(Binder Resin)

The binder resin is typically a main component (for example, at least 85% by mass) of the toner mother particles. Properties of the binder resin are therefore thought to have great influence on properties of the toner mother particles as a whole. For example, in a configuration in which the binder resin has an ester group, a hydroxyl group, an ether group, an acid group, or a methyl group, the toner mother particles have a strong tendency to be anionic. In a configuration in which the binder resin has an amino group, the toner mother particles have a strong tendency to be cationic.

In the toner having the above-described basic features, the toner mother particles each contain the crystalline polyester resin, the non-crystalline polyester resin, and the styrene-acrylic acid-based resin as the binder resin.

The polyester resins can each be yielded by condensation polymerization of at least one polyhydric alcohol and at least one polybasic carboxylic acid. However, in the above-described "Basic Features of Toner", the crystalline polyester resin includes the first repeating unit derived from an acrylic acid-based monomer and the second repeating unit derived from a styrene-based monomer.

The styrene-acrylic acid-based resin is a copolymer of at least one styrene-based monomer and at least one acrylic acid-based monomer. However, in the above-described "Basic Features of Toner", the styrene-acrylic acid-based resin includes the third repeating unit derived from an acrylic acid-based monomer that has an epoxy group and the fourth repeating unit derived from a styrene-based monomer.

Preferable examples of monomers (resin raw materials) for synthesizing the polyester resins and the styrene-acrylic acid-based resin are listed below. Specifically, the preferable examples of the monomers include alcohols (specific examples include aliphatic diols, bisphenols, and tri- or higher-hydric alcohols), carboxylic acids (specific examples include dibasic carboxylic acids and tri- or higher-basic carboxylic acids), styrene-based monomers, and acrylic acid-based monomers (specific examples include acrylic acid-based monomers that do not have an epoxy group and acrylic acid-based monomers that have an epoxy group).

Preferable examples of aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-buten-1,4-diol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Preferable examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Preferable examples of styrene-based monomers include styrene, alkyl styrenes (specific examples include a-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Preferable examples of acrylic acid-based monomers that do not have an epoxy group include (meth)acrylic acid, (meth)acrylonitrile, (meth)acrylic acid alkyl esters, and (meth)acrylic acid hydroxyalkyl esters. Preferable examples of (meth)acrylic acid alkyl esters include methyl (meth) acrylate, ethyl (meth)acrylate, n-propyl (meth)acrylate, isopropyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth) acrylate, 2-hydroxypropyl (meth)acrylate, and 4-hydroxybutyl (meth)acrylate.

Preferable examples of acrylic acid-based monomers that have an epoxy group include glycidyl (meth)acrylate (specific examples include glycidyl acrylate and glycidyl methacrylate).

In the above-described "Basic Features of Toner", the crystalline polyester resin includes the first repeating unit derived from an acrylic acid-based monomer and the second repeating unit derived from a styrene-based monomer.

A first preferable example of the crystalline polyester resin (the binder resin) is a polymer of monomers (resin raw materials) including at least one α,ω-alkanediol having a carbon number of at least 2 and no greater than 8 (for example, 1,4-butanediol having a carbon number of 4 and/or 1,6-hexanediol having a carbon number of 6), at least one unsaturated dicarboxylic acid (specific examples include fumaric acid), at least one styrene-based monomer (specific examples include styrene), and at least one (meth)acrylic acid (specific examples include acrylic acid and methacrylic acid).

A second preferable example of the crystalline polyester resin (the binder resin) is a polymer of monomers (resin raw materials) including at least one α,ω-alkanediol having a carbon number of at least 2 and no greater than 8 (for example, 1,4-butanediol having a carbon number of 4 and/or 1,6-hexanediol having a carbon number of 6), at least one α,ω-alkane dicarboxylic acid having a carbon number (specifically, the number of carbon atoms including carbon atoms in two carboxyl groups) of at least 4 and no greater than 10 (specific examples include sebacic acid having a carbon number of 10), at least one styrene-based monomer (specific examples include styrene), and at least one (meth) acrylic acid (specific examples include acrylic acid and methacrylic acid).

In the above-described "Basic Features of Toner", the styrene-acrylic acid-based resin includes the third repeating unit derived from an acrylic acid-based monomer that has an epoxy group and the fourth repeating unit derived from a styrene-based monomer. Preferable examples of the styrene-acrylic acid-based resin (the binder resin) include a polymer of monomers (resin raw materials) including at least one styrene-based monomer (specific examples include styrene), at least one glycidyl (meth)acrylate (specific examples include glycidyl acrylate and glycidyl methacrylate), at least one (meth)acrylic acid alkyl ester (specific examples include n-butyl acrylate that has a butyl group having a carbon number of 4 in an ester portion thereof) that has an alkyl group having a carbon number of at least 2 and no greater than 8 in an ester portion thereof, and at least one (meth) acrylic acid (specific examples include acrylic acid and methacrylic acid).

Preferable examples of the non-crystalline polyester resin include non-crystalline polyester resins including: a bisphenol (for example, a bisphenol A ethylene oxide adduct and/or a bisphenol A propylene oxide adduct) as an alcohol component; and an aromatic dicarboxylic acid (for example, a terephthalic acid) and/or an unsaturated dicarboxylic acid (for example, a fumaric acid) and a tri- or higher-basic carboxylic acid (for example, a trimellitic acid) as acid components.

(Colorant)

The toner mother particles may each contain the colorant. A known pigment or dye that matches the color of the toner can be used as the colorant. In order to obtain a toner suitable for image formation, an amount of the colorant is preferably at least 1 part by mass and no greater than 20 parts by mass relative to 100 parts by mass of the binder resin.

The toner mother particles may each contain a black colorant. An example of the black colorant is carbon black. Alternatively, the black colorant may be a colorant adjusted to black color using a yellow colorant, a magenta colorant, and a cyan colorant.

The toner mother particles may each contain a non-black colorant such as a yellow colorant, a magenta colorant, or a cyan colorant.

For example, at least one compound selected from the group consisting of condensed azo compounds, isoindolinone compounds, anthraquinone compounds, azo metal complexes, methine compounds, and arylamide compounds can be used as the yellow colorant. Specific examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

For example, at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as the magenta colorant. Specific examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

For example, at least one compound selected from the group consisting of copper phthalocyanine compounds, anthraquinone compounds, and basic dye lake compounds can be used as the cyan colorant. Specific examples of cyan colorants that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

In the toner having the above-described basic features, the toner mother particles each contain the releasing agent. The amount of the releasing agent contained in the toner is at least 7.5% by mass and no greater than 12.5% by mass. As the releasing agent contained in the toner mother particles, an ester wax (more specifically, a synthetic ester wax or a natural ester wax) is preferable, and a synthetic ester wax is particularly preferable. When a synthetic ester wax is used as the releasing agent, a melting point of the releasing agent is easily adjustable to within a desired range. For example, a synthetic ester wax can be synthesized through reaction between an alcohol and a carboxylic acid (or a carboxylic acid halide) in the presence of an acid catalyst. A raw material for the synthetic ester wax may for example be a substance derived from a natural product, such as a long-chain fatty acid obtained from a natural oil or fat, or a commercially available synthetic product. As a natural ester wax, a carnauba wax or a rice wax is preferable. A single releasing agent may be used alone, or a plurality of releasing agents may be used in combination.

(Charge Control Agent)

The toner mother particles may each contain the charge control agent. The charge control agent is used for example in order to improve charge stability or a charge rise characteristic of the toner. The charge rise characteristic of the toner is an indicator as to whether or not the toner is chargeable to a specific charge level in a short period of time.

Anionicity of the toner mother particles can be increased by inclusion of a negatively chargeable charge control agent (specific examples include organic metal complexes and chelate compounds) in the toner mother particles. Cationicity of the toner mother particles can be increased by inclusion of a positively chargeable charge control agent (specific examples include pyridine, nigrosine, and quaternary ammonium salt) in the toner mother particles. However, the toner mother particles need not contain the charge control agent in a configuration in which the toner has sufficient chargeability without the charge control agent.

(Magnetic Powder)

The toner mother particles may each contain the magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specifically, carbon materials imparted with ferromagnetism through thermal treatment). A single magnetic powder may be used alone or a plurality of magnetic powders may be used in combination.

(External Additive)

The external additive (specifically, a powder including a plurality of external additive particles) may be caused to adhere to the surfaces of the toner mother particles. Unlike internal additives, the external additive is not present inside the toner mother particles, and is selectively present on the surfaces of the toner mother particles (i.e., in surface layer portions of the toner particles) only. For example, the external additive particles can be caused to adhere to the surfaces of the toner mother particles by stirring the toner mother particles (a powder) and the external additive (a powder) together. The toner mother particles and the external additive particles do not chemically react with each other. The toner mother particles and the external additive particles bond with each other physically rather than chemically. Strength of the bond between the toner mother particles and the external additive particles is adjustable by controlling stirring conditions (specific examples include a stirring time and a rotational speed of the stirring), a particle diameter, a shape, and surface conditions of the external additive particles.

In order to make the external additive exhibit its function while preventing detachment of the external additive particles from the toner particles, an amount of the external additive (in a configuration in which plural types of external additive particles are used, a total amount of the respective types of external additive particles) is preferably at least 0.5 parts by mass and no greater than 10 parts by mass relative to 100 parts by mass of the toner mother particles.

Inorganic particles are preferable as the external additive particles, and silica particles and particles of metal oxides (specific examples include alumina, titanium oxide, magnesium oxide, zinc oxide, strontium titanate, and barium titanate) are particularly preferable. In order to improve fluidity of the toner, it is preferable to use as the external additive particles, inorganic particles (a powder) having a number average primary particle diameter of at least 5 nm and no greater than 30 nm. However, particles of organic acid compounds such as fatty acid metal salts (specific examples include zinc stearate) or resin particles may be used as the external additive particles. Alternatively, composite particles that are a composite of a plurality of materials may be used as the external additive particles. A single type of external additive particles may be used alone or plural types of external additive particles may be used in combination.

Surface treatment may be performed on the external additive particles. For example, in a situation in which silica particles are used as the external additive particles, hydrophobicity and/or positive chargeability may be imparted to surfaces of the silica particles using a surface treatment agent. Examples of surface treatment agents that can be preferably used include coupling agents (specific examples include silane coupling agents, titanate coupling agents, and aluminate coupling agents), silazane compounds (for example, chain silazane compounds and cyclic silazane compounds), and silicone oils (specific examples include dimethylsilicone oil). Silane coupling agents and silazane compounds are particularly preferable as the surface treatment agent. Preferable examples of silane coupling agents include silane compounds (specific examples include methyltrimethoxysilane and aminosilane). Preferable examples of silazane compounds include hexamethyldisilazane (HMDS). When a surface of a silica base (an untreated silica particle) is treated with a surface treatment agent, a large number of hydroxyl groups (—OH) present on the surface of the silica base are partially or entirely replaced by functional groups derived from the surface treatment agent. Through the above, silica particles having functional groups (specifically, functional groups that are more hydrophobic and/or more positively chargeable than hydroxyl groups) derived from the surface treatment agent on surfaces thereof are obtained.

EXAMPLES

The following describes examples of the present disclosure. Table 1 indicates toners TA-1 to TA-10 and TB-1 to TB-10 (each of which is an electrostatic latent image developing toner) according to the examples and comparative examples. Tables 2 and 3 indicate binder resins (non-crystalline polyester resins and crystalline polyester resins) used in production of the respective toners indicated in Table 1. In Tables 1 to 3, "APES" indicates non-crystalline polyester resins, "CPES" indicates crystalline polyester resins, and "SAc" indicates styrene-acrylic acid-based resins. In Table 1, "CCA" indicates a charge control agent. In Tables 2 and 3, "First component" indicates alcohol components, "Second component" indicates acid components, and "Third component" indicates styrene-acrylic acid-based components. In Table 1, "Amount (unit: wt %)" indicates mass ratios of respective materials relative to a total mass of the binder resin and internal additives. In Tables 2 and 3, "molar ratio" indicates amounts (parts by mole) of respective materials relative to 100 parts by mole of a total amount of acid components.

TABLE 1

| | Binder resin | | | | | | Releasing | | |
|---|---|---|---|---|---|---|---|---|---|
| | APES | | CPES | | SAc | | agent | CCA | Colorant |
| Toner | Type | Amount [wt %] | Type | Amount [wt %] | Type | Amount [wt %] | Amount [wt %] | Amount [wt %] | Amount [wt %] |
| TA-1 | 1 | 67.5 | 1 | 10.0 | 1 | 7.5 | 10.0 | 1.0 | 4.0 |
| TA-2 | 2 | 67.5 | 1 | 10.0 | 1 | 7.5 | 10.0 | 1.0 | 4.0 |
| TA-3 | 1 | 70.0 | 1 | 7.5 | 1 | 7.5 | 10.0 | 1.0 | 4.0 |
| TA-4 | 2 | 65.0 | 2 | 12.5 | 1 | 7.5 | 10.0 | 1.0 | 4.0 |
| TA-5 | 1 | 70.0 | 1 | 10.0 | 1 | 7.5 | 7.5 | 1.0 | 4.0 |
| TA-6 | 1 | 65.0 | 1 | 10.0 | 1 | 7.5 | 12.5 | 1.0 | 4.0 |
| TA-7 | 1 | 70.0 | 1 | 10.0 | 1 | 5.0 | 10.0 | 1.0 | 4.0 |
| TA-8 | 1 | 65.0 | 1 | 10.0 | 1 | 10.0 | 10.0 | 1.0 | 4.0 |

TABLE 1-continued

| Toner | Binder resin APES Type | Binder resin APES Amount [wt %] | Binder resin CPES Type | Binder resin CPES Amount [wt %] | Binder resin SAc Type | Binder resin SAc Amount [wt %] | Releasing agent Amount [wt %] | CCA Amount [wt %] | Colorant Amount [wt %] |
|---|---|---|---|---|---|---|---|---|---|
| TA-9 | 1 | 67.5 | 3 | 10.0 | 1 | 7.5 | 10.0 | 1.0 | 4.0 |
| TA-10 | 1 | 67.5 | 4 | 10.0 | 1 | 7.5 | 10.0 | 1.0 | 4.0 |
| TB-1 | 3 | 67.5 | 1 | 10.0 | 1 | 7.5 | 10.0 | 1.0 | 4.0 |
| TB-2 | 4 | 67.5 | 1 | 10.0 | 1 | 7.5 | 10.0 | 1.0 | 4.0 |
| TB-3 | 1 | 72.5 | 1 | 5.0 | 1 | 7.5 | 10.0 | 1.0 | 4.0 |
| TB-4 | 2 | 62.5 | 2 | 15.0 | 1 | 7.5 | 10.0 | 1.0 | 4.0 |
| TB-5 | 1 | 73.0 | 1 | 10.0 | 1 | 5.0 | 7.0 | 1.0 | 4.0 |
| TB-6 | 1 | 62.0 | 1 | 10.0 | 1 | 10.0 | 13.0 | 1.0 | 4.0 |
| TB-7 | 1 | 71.0 | 1 | 10.0 | 1 | 4.0 | 10.0 | 1.0 | 4.0 |
| TB-8 | 1 | 64.0 | 1 | 10.0 | 1 | 11.0 | 10.0 | 1.0 | 4.0 |
| TB-9 | 1 | 75.0 | 1 | 10.0 | None | 0.0 | 10.0 | 1.0 | 4.0 |
| TB-10 | 1 | 67.5 | 1 | 10.0 | 2 | 7.5 | 10.0 | 1.0 | 4.0 |

TABLE 2

| Non-crystalline polyester resin (APES) | | 1 | 2 | 3 | 4 |
|---|---|---|---|---|---|
| First component: Amount (molar ratio) | BPA-PO | 1,450 g (70) | 1,450 g (70) | 1,450 g (70) | 1,450 g (70) |
| | BPA-EO | 580 g (30) | 580 g (30) | 580 g (30) | 580 g (30) |
| Second component: Amount (molar ratio) | Fumaric acid | 370 g (25) | 296 g (20) | 440 g (30) | 980 g (15) |
| | Terephthalic acid | 1,500 g (70) | 1,390 g (65) | 1,500 g (70) | 980 g (65) |
| | Trimellitic acid | 120 g (5) | 360 g (15) | — | 480 g (20) |
| Softening point [° C.] | | 131.1 | 142.2 | 122.5 | 148.5 |
| Glass transition point [° C.] | | 60.8 | 64.3 | 55.0 | 68.2 |
| Acid value [mgKOH/g] | | 14 | 29 | 8 | 33 |
| Hydroxyl value [mgKOH/g] | | 31 | 40 | 20 | 50 |
| Mass average molecular weight (Mw) | | 42,000 | 64,500 | 38,000 | 67,000 |
| Number average molecular weight (Mn) | | 3,660 | 3,418 | 2,500 | 3,600 |
| SP value [$(cal/cm^3)^{1/2}$] | | 12.4 | 12.5 | 12.4 | 12.5 |

TABLE 3

| Crystalline polyester resin (CPES) | | 1 | 2 | 3 | 4 |
|---|---|---|---|---|---|
| First component: Amount (molar ratio) | 1,4-butanediol | 1,560 g (100) | 1,560 g (100) | — | 1,560 g (100) |
| | 1,6-hexanediol | — | 162 g (10) | 1,620 g (100) | 162 g (10) |
| Second component: Amount (molar ratio) | Fumaric acid | — | 1,390 g (100) | — | 1,390 g (100) |
| | Sebacic acid | 1,480 g (100) | — | 1,480 g (100) | — |
| Third component: Amount (molar ratio) | Styrene | 138 g (5.6) | 276 g (11.2) | 138 g (5.6) | 69 g (2.8) |
| | Methacrylic acid | 108 g (4.4) | 216 g (8.8) | 108 g (4.4) | 54 g (2.2) |
| Softening point [° C.] | | 89 | 93 | 90 | 90 |
| Melting point [° C.] | | 79 | 79 | 84 | 83 |
| Acid value [mgKOH/g] | | 3.0 | 3.5 | 3.6 | 3.0 |
| Hydroxyl value [mgKOH/g] | | 7.0 | 11.1 | 13.5 | 22.0 |
| Mass average molecular weight (Mw) | | 53,600 | 73,200 | 57,700 | 43,500 |
| Number average molecular weight (Mn) | | 3,590 | 3,850 | 5,170 | 3,890 |
| SP value [$(cal/cm^3)^{1/2}$] | | 10.0 | 10.6 | 9.8 | 10.8 |

The following describes production methods, evaluation methods, and evaluation results of the toners TA-1 to TA-10 and TB-1 to TB-10 in order. In evaluations in which errors may occur, an evaluation value was calculated by calculating an arithmetic mean of an appropriate number of measured values to ensure that any errors were sufficiently small.

[Preparation of Materials]

(Synthesis of Non-Crystalline Polyester Resins APES-1 to APES-4)

A 5-L four-necked flask equipped with a thermometer (a thermocouple), a dewatering conduit, a nitrogen inlet tube, and a stirrer was charged with alcohol components (first components) and acid components (second components) indicated in Table 2 and 4 g of dibutyl tin oxide. For example, in synthesis of a non-crystalline polyester resin APES-1, 1,450 g (70 parts by mole) of BPA-PO (a bisphenol A propylene oxide adduct) and 580 g (30 parts by mole) of BPA-EO (a bisphenol A ethylene oxide adduct) were added as the alcohol components, and 370 g (25 parts by mole) of a fumaric acid, 1,500 g (70 parts by mole) of a terephthalic acid, and 120 g (5 parts by mole) of a trimellitic acid were added as the acid components (see Table 2). The flask contents were caused to react for 9 hours at a temperature of 220° C.

Subsequently, the flask contents were caused to react in a depressurized atmosphere (pressure: 8 kPa) until a resultant reaction product (a resin) has a softening point (Tm) indicated in Table 2. Through the above, non-crystalline polyester resins (non-crystalline polyester resins APES-1 to APES-4) were each obtained. Table 2 indicates physical properties of the obtained non-crystalline polyester resins APES-1 to APES-4. For example, the non-crystalline polyester resin APES-1 had a softening point (Tm) of 131.1° C., a glass transition point (Tg) of 60.8° C., an acid value (AV) of 14 mgKOH/g, a hydroxyl value (OHV) of 31 mgKOH/g, a mass average molecular weight (Mw) of 42,000, a number average molecular weight (Mn) of 3,660, and an SP value of 12.4 $(cal/cm^3)^{1/2}$.

(Synthesis of Crystalline Polyester Resins CPES-1 to CPES-4)

A 5-L four-necked flask equipped with a thermometer (a thermocouple), a dewatering conduit, a nitrogen inlet tube, and a stirrer was charged with an alcohol component or alcohol components (a first component or first components), an acid component (a second component), styrene-acrylic acid-based components (third components) indicated in Table 3, and 2.5 g of 1,4-benzenediol. For example, in synthesis of a crystalline polyester resin CPES-1, 1,560 g (100 parts by mole) of 1,4-butanediol was added as the alcohol component, 1,480 g (100 parts by mole) of a sebacic acid was added as the acid component, and 138 g (5.6 parts by mole) of styrene and 108 g (4.4 parts by mole) of a methacrylic acid were added as the styrene-acrylic acid-based components (see Table 3).

The flask contents were caused to react for 5 hours at a temperature of 170° C. Subsequently, the flask contents were caused to react for 1.5 hours at a temperature of 210° C. Subsequently, the flask contents were caused to react in a depressurized atmosphere (pressure: 8 kPa) at the temperature of 210° C. until a resultant reaction product (a resin) has a softening point (Tm) indicated in Table 3. Through the above, crystalline polyester resins (crystalline polyester resins CPES-1 to CPES-4) were each obtained. Table 3 indicates physical properties of the obtained crystalline polyester resins CPES-1 to CPES-4. For example, the crystalline polyester resin CPES-1 had a softening point (Tm) of 89° C., a melting point (Mp) of 79° C., an acid value (AV) of 3.0 mgKOH/g, a hydroxyl value (OHV) of 7.0 mgKOH/g, a mass average molecular weight (Mw) of 53,600, a number average molecular weight (Mn) of 3,590, and an SP value of 10.0 $(cal/cm^3)^{1/2}$.

(Synthesis of Styrene-Acrylic Acid-based Resin SAc1)

A reaction vessel equipped with a stirrer and a thermometer was charged with 70 parts by mass of xylene, 80 parts by mass of styrene, 15 parts by mass of n-butyl acrylate, 1 part by mass of a methacrylic acid, 10 parts by mass of glycidyl methacrylate, and 1.6 parts by mass of di-tert-butyl peroxide. The vessel contents had a temperature of 40° C. The temperature of the vessel contents was increased from 40° C. to 130° C. over 60 minutes while stirring the vessel contents. Once the temperature of the vessel contents reached 130° C., the vessel contents were caused to react (specifically, polymerize) for further 2 hours. Thereafter, the vessel contents were cooled to obtain a dispersion of a styrene-acrylic acid-based resin. The obtained dispersion was filtered (subjected to solid-liquid separation) to obtain resin particles (a powder). Thereafter, washing and drying were performed to obtain a styrene-acrylic acid-based resin SAc1.

(Synthesis of Styrene-Acrylic Acid-Based Resin SAc2)

A reaction vessel equipped with a stirrer and a thermometer was charged with 150 parts by mass of ion exchanged water, 0.03 parts by mass of an aqueous solution of sodium polyacrylate having a solid concentration of 3.0% by mass, and 0.4 parts by mass of sodium sulfate. Subsequently, 75 parts by mass of styrene, 25 parts by mass of n-butyl acrylate, 0.3 parts by mass of trimethylolpropane triacrylate, and 3.8 parts by mass of a peroxide polymerization initiator (specifically, 3 parts by mass of benzoyl peroxide and 0.8 parts by mass of t-butylperoxy-2-ethylhexyl monocarbonate) were added into the vessel. The vessel contents had a temperature of 40° C.

The temperature of the vessel contents was increased from 40° C. to 130° C. over 65 minutes while stirring the vessel contents. Once the temperature of the vessel contents reached 130° C., the vessel contents were caused to react (specifically, polymerize) for further 2.5 hours. Thereafter, the vessel contents were cooled to obtain a dispersion of a styrene-acrylic acid-based resin. The obtained dispersion was filtered (subjected to solid-liquid separation) to obtain resin particles (a powder). Thereafter, washing and drying were performed to obtain a styrene-acrylic acid-based resin SAc2.

[Method for Producing Toner]

(Preparation of Toner Mother Particles)

First, a non-crystalline polyester resin (any of the non-crystalline polyester resins APES-1 to APES-4 specified for each toner) of a type and an amount indicated in Table 1, a crystalline polyester resin (any of the crystalline polyester resins CPES-1 to CPES-4 specified for each toner) of a type and an amount indicated in Table 1, a styrene-acrylic acid-based resin (either of the styrene-acrylic acid-based resins SAc1 and SAc2 specified for each toner) of a type and an amount indicated in Table 1, a releasing agent (a synthetic ester wax: "NISSAN ELECTOL (registered Japanese trademark) WEP-9" manufactured by NOF Corporation) of an amount indicated in Table 1, 1 part by mass of a charge control agent (a quaternary ammonium salt: "BONTRON (registered Japanese trademark) P-51" manufactured by ORIENT CHEMICAL INDUSTRIES, Co., Ltd.), and 4 parts by mass of a colorant (carbon black: "MA-100" manufactured by Mitsubishi Chemical Corporation) were mixed using an FM mixer ("FM-20B" manufactured by Nippon Coke & Engineering Co., Ltd.). For example, in production of the toner TA-1, 67.5 parts by mass of the non-crystalline polyester resin APES-1, 10.0 parts by mass of the crystalline polyester resin CPES-1, 7.5 parts by mass of the styrene-acrylic acid-based resin SAc1, 10.0 parts by mass of the releasing agent (NISSAN ELECTOL WEP-9), 1.0 part by mass of the charge control agent (BONTRON P-51), and 4.0 parts by mass of the colorant (MA-100) were mixed. In production of the toner TB-9, no styrene-acrylic acid-based resin was added.

Subsequently, the resultant mixture was melt-kneaded using a twin-screw extruder ("PCM-30" manufactured by Ikegai Corp.) under conditions of a material feeding rate of 6 kg/hour, a shaft rotational speed of 160 rpm, and a set temperature (a cylinder temperature) of 120° C. Thereafter, the resultant kneaded product was cooled. Subsequently, the cooled kneaded product was coarsely pulverized using a pulverizer ("ROTOPLEX 16/8" manufactured by former TOA MACHINERY MFG). Subsequently, the resultant coarsely pulverized product was finely pulverized using a pulverizer ("Turbo Mill model RS" manufactured by FREUND-TURBO CORPORATION). Subsequently, the resultant finely pulverized product was classified using a classifier ("Elbow Jet Type EJ-LABO" manufactured by Nittetsu Mining Co., Ltd.). Through the above, toner mother particles having a volume median diameter ($D_{50}$) of 7 μm were obtained.

(External Addition Process)

First, 100 parts by mass of the toner mother particles, 1.5 parts by mass of hydrophobic silica particulates ("AEROSIL (registered Japanese trademark) RA-200H" manufactured by Nippon Aerosil Co., Ltd., contents: dry silica particles surface modified with trimethylsilyl group and amino group, number average primary particle diameter: approximately 12 nm), and 0.8 parts by mass of electrically conductive titanium oxide particulates ("EC-100" manufactured by Titan Kogyo, Ltd., base: $TiO_2$ particles, coat layer: Sb-doped $SnO_2$ film, number average primary particle diameter: approximately 0.35 μm) were mixed for 2 minutes using an FM mixer ("FM-10B" manufactured by Nippon Coke & Engineering Co., Ltd.) under conditions of a rotational speed of 3,000 rpm and a jacket temperature of 20° C. Through the above, the external additive adhered to surfaces of the toner mother particles. Thereafter, sifting was performed using a 300-mesh screen (opening: 48 μm). Thus, a toner (each of the toners TA-1 to TA-10 and TB-1 to TB-10) including a large number of toner particles was obtained.

Table 4 indicates results of measurement of a peak top molecular weight ($M_{pt}$) in the GPC molecular weight distribution (the differential molecular weight distribution curve) and a mass average molecular weight (Mw) of each of the thus obtained toners TA-1 to TA-10 and TB-1 to TB-10.

TABLE 4

| Toner | Peak top molecular weight ($M_{pt}$) | Mass average molecular weight (Mw) |
|---|---|---|
| TA-1 | 8,400 | 45,000 |
| TA-2 | 11,000 | 63,000 |
| TA-3 | 8,000 | 42,000 |
| TA-4 | 11,500 | 64,000 |
| TA-5 | 8,500 | 44,000 |
| TA-6 | 8,600 | 47,000 |
| TA-7 | 8,500 | 48,000 |
| TA-8 | 8,300 | 42,000 |
| TA-9 | 8,450 | 45,500 |
| TA-10 | 8,350 | 46,000 |
| TB-1 | 8,100 | 38,000 |

TABLE 4-continued

| Toner | Peak top molecular weight ($M_{pt}$) | Mass average molecular weight (Mw) |
|---|---|---|
| TB-2 | 11,500 | 66,800 |
| TB-3 | 7,800 | 40,000 |
| TB-4 | 12,500 | 65,000 |
| TB-5 | 8,400 | 46,000 |
| TB-6 | 8,450 | 48,000 |
| TB-7 | 8,350 | 46,500 |
| TB-8 | 8,250 | 44,500 |
| TB-9 | 8,300 | 47,500 |
| TB-10 | 8,500 | 46,000 |

For example, the toner TA-1 had a peak top molecular weight ($M_{pt}$) of 8,400 and a mass average molecular weight (Mw) of 45,000. The molecular weights were measured by a method described below.

<Method for Measuring Molecular Weight>

First, 5 mL of tetrahydrofuran (THF) and 10 mg of a sample (a measurement target: any of the toners TA-1 to TB-10) were placed in a vessel and left to stand for 2 hours at room temperature (approximately 25° C.). Thereafter, the vessel contents were shaken to sufficiently mix THF and the toner within the vessel. Subsequently, the vessel contents were filtered using a sample treatment filter ("TITAN2" manufactured by Tomsic Ltd., filter: polytetrafluoroethylene (PTFE) membrane (non-aqueous type), size (diameter): 30 mm, pore diameter: 0.45 μm) to obtain as a filtrate (a liquid passed through the filter), a THF solution containing THF soluble components of the toner. The obtained THF solution (hereinafter referred to as a sample solution) was used as a measurement target.

A gel permeation chromatography (GPC) device ("HLC-8220GPC" manufactured by Tosoh Corporation) was used as a measuring device. A polystyrene gel column obtained by combining two columns for organic solvent size exclusion chromatography (SEC) ("TSKgel GMHXL" manufactured by Tosoh Corporation, filler: styrene-based polymer, column size: 7.8 mm (inside diameter)×30 cm (length), filler particle diameter: 9 μm) in series was used as a column. A refractive index (RI) detector was used as a detector. The measurement range was molecular weights from $1.0\times10^2$ to $1.0\times10^6$.

The column was set in a heat chamber of the measuring device. The column was stabilized within the heat chamber while controlling a temperature of the heat chamber at 40° C. Subsequently, a solvent (THF) was caused to flow at a flow rate of 1 mL/minute in the column at the temperature of 40° C., and approximately 150 μL of the sample solution (the measurement target: the THF solution prepared as described above) was introduced into the column. An elution curve (vertical axis: detection intensity (detection count), horizontal axis: elution time) of the sample solution introduced into the column was measured. GPC molecular weight distribution (a differential molecular weight distribution curve) and a mass average molecular weight (Mw) of the sample (toner) were determined on the basis of the obtained elution curve and a calibration curve (a graph that indicates relation between a logarithmic value of a molecular weight and an elution time for each standard substance of a known molecular weight) obtained as described below. Further, a peak top molecular weight ($M_{pt}$) was determined on the basis of the obtained GPC molecular weight distribution.

The calibration curve was prepared using monodispersed polystyrenes (standard substances). The monodispersed polystyrenes used as the standard substances were ten types of standard polystyrenes (product of Tosoh Corporation) having predetermined molecular weights. The respective molecular weights of the standard polystyrenes were determined on the basis of the measurement range.

[Evaluation Methods]

Each sample (each of the toners TA-1 to TA-10 and TB-1 to TB-10) was evaluated by methods described below.

(Preparation of Evaluation Developer)

An evaluation developer (a two-component developer) was prepared by mixing 100 parts by mass of a developer carrier (a carrier for "FS-C5250DN" manufactured by KYOCERA Document Solutions Inc.) and 5 parts by mass of the sample (the toner) for 30 minutes using a ball mill.

(Fixability)

A printer ("FS-C5250DN" manufactured by KYOCERA Document Solutions Inc., modified to enable adjustment of fixing temperature) including a roller-roller type heat-pressure fixing device was used as an evaluation apparatus. The evaluation developer (the two-component developer) prepared as described above was loaded into a developing device of the evaluation apparatus, and the sample (the toner for replenishment use) was loaded into a toner container of the evaluation apparatus.

A solid image (specifically, an unfixed toner image) having a size of 25 mm×25 mm was formed on evaluation paper ("COLORCOPY (registered Japanese trademark)" manufactured by Mondi, A4 size, basis weight of 90 g/m$^2$) using the evaluation apparatus under conditions of a linear velocity of 200 mm/second and a toner application amount of 1.0 mg/cm$^2$. Subsequently, the paper with the image formed thereon was passed through the fixing device of the evaluation apparatus. A distance from the leading edge of the evaluation paper to the solid image was 5 mm.

In evaluation of a minimum fixing temperature, a setting range of the fixing temperature was from 100° C. to 200° C. Specifically, a minimum temperature (the minimum fixing temperature) at which the solid image (the toner image) was fixable to the paper was measured by increasing the fixing temperature of the fixing device from 100° C. in increments of 5° C. and determining for each fixing temperature whether or not the solid image was fixable. Whether or not the toner was fixable was determined by a fold-rubbing test as described below. Specifically, the evaluation paper passed through the fixing device was folded in half such that a surface on which the image had been formed was folded inwards, and a 1-kg brass weight covered with cloth was rubbed on the fold back and forth five times. Subsequently, the paper was unfolded and a folded part (a part on which the solid image had been formed) of the paper was observed. A length of peeling of the toner (a peeling length) in the folded part was measured. The lowest temperature among fixing temperatures for which the peeling length was not longer than 1 mm was determined as the minimum fixing temperature. A minimum fixing temperature not higher than 145° C. was evaluated as "good", and a minimum fixing temperature higher than 145° C. was evaluated as "poor".

Also, a maximum fixing temperature was measured within a fixing temperature range from 150° C. to 230° C. Specifically, a maximum temperature (the maximum fixing temperature) at which hot offset did not occur was measured by increasing the fixing temperature of the fixing device from 150° C. in increments of 5° C. and determining for each fixing temperature whether or not hot offset occurred. Whether or not hot offset occurred was determined by visually observing the evaluation paper passed through the fixing device. Specifically, it was determined that offset occurred when a stain was made on the evaluation paper due to adhesion of the toner to a fixing roller. A maximum fixing temperature not lower than 185° C. was evaluated as "good", and a maximum fixing temperature lower than 185° C. was evaluated as "poor".

(Releasability)

An evaluation apparatus (specifically, an evaluation apparatus loaded with the evaluation developer) was prepared similarly to the above-described evaluation of fixability, and a solid image (specifically, an unfixed toner image) having a size of 25 mm×25 mm was formed on evaluation paper ("COLORCOPY" manufactured by Mondi, A4 size, basis weight of 90 g/m$^2$) using the evaluation apparatus under conditions of a linear velocity of 200 mm/second and a toner application amount of 1.0 mg/cm$^2$. Subsequently, the paper with the image formed thereon was passed through the fixing device of the evaluation apparatus.

In formation of the image, a distance from the leading edge of the evaluation paper to the solid image was set at a predetermined distance (10 mm, 5 mm, or 3 mm) and the fixing temperature was set at a predetermined temperature (160° C., 170° C., or 180° C.). Releasability of the toner was evaluated for each of all combinations (the following nine combinations: Conditions 1 to 9) of the above-described three conditions regarding the position of the image to be formed and the above-described three conditions regarding the fixing temperature. Evaluation was performed in order from Condition 1 to Condition 9.

Condition 1: the fixing temperature was 160° C. and the position of the image was 10 mm Condition 2: the fixing temperature was 160° C. and the position of the image was 5 mm Condition 3: the fixing temperature was 160° C. and the position of the image was 3 mm Condition 4: the fixing temperature was 170° C. and the position of the image was 10 mm Condition 5: the fixing temperature was 170° C. and the position of the image was 5 mm Condition 6: the fixing temperature was 170° C. and the position of the image was 3 mm Condition 7: the fixing temperature was 180° C. and the position of the image was 10 mm Condition 8: the fixing temperature was 180° C. and the position of the image was 5 mm Condition 9: the fixing temperature was 180° C. and the position of the image was 3 mm As for releasability of the toner, it was determined that a separation defect occurred in a situation in which the paper wound around the fixing roller (for example, in a situation in which paper jam occurred), and it was determined that the separation defect did not occur in a situation in which the evaluation paper was ejected without winding around the fixing roller. Releasability of the toner was evaluated on the basis of the number of times it was determined that the separation defect occurred for the nine conditions (Conditions 1 to 9). When the number of times was zero (i.e., the separation defect did not occur under all conditions), releasability of the toner was evaluated as "very good". When the number of times was one, releasability of the toner was evaluated as "good". When the number of times was two or more, releasability of the toner was evaluated as "poor".

(Pulverizability)

In production of each sample (each of the toners TA-1 to TA-10 and TB-1 to TB-10), an electric current value (specifically, an electric current value of an inverter described below) of the pulverizer (Turbo Mill model RS) was measured in the fine pulverization process (set particle diameter:

volume median diameter of 7 μm) performed after the kneaded product was coarsely pulverized using the pulverizer (ROTOPLEX 16/8).

The pulverizer (Turbo Mill model RS) includes a rotor, a motor that drives the rotor, a belt for transmitting driving force of the motor to the rotor, and the inverter for controlling rotational movement of the motor. A particle diameter of a finely pulverized product to be obtained is adjustable through control of a rotational speed of the motor (and a rotational speed of the rotor). In evaluation of pulverizability, an electric current value corresponding to torque of the motor was measured at a specific part (specifically, a power line of 200 V) of the inverter using a clamp type analogue ampere meter.

When the measured electric current value was smaller than 27 A, pulverizability of the toner was evaluated as "good". When the measured electric current value was not smaller than 27 A, pulverizability of the toner was evaluated as "poor".

[Evaluation Results]

Table 5 indicates evaluation results of each sample (each of the toners TA-1 to TA-10 and TB-1 to TB-10). Table 5 indicates evaluation results of fixability (the minimum fixing temperature and the maximum fixing temperature), releasability (the number of times it was determined that the separation defect occurred for the nine conditions), and pulverizability (the electric current value). As for the toner TB-10, evaluations other than the evaluation of pulverizability were not performed since pulverizability of the toner TB-10 was evaluated as extremely poor.

TABLE 5

| | Toner | Fixability [° C.] Minimum | Fixability [° C.] Maximum | Releasability Number of times of occurrence of defect | Pulverizability [A] |
|---|---|---|---|---|---|
| Example 1 | TA-1 | 130 | 185 | 0/9 | 23 |
| Example 2 | TA-2 | 140 | 195 | 0/9 | 25 |
| Example 3 | TA-3 | 130 | 185 | 0/9 | 22 |
| Example 4 | TA-4 | 125 | 190 | 0/9 | 26 |
| Example 5 | TA-5 | 140 | 185 | 0/9 | 25 |
| Example 6 | TA-6 | 135 | 200 | 0/9 | 23 |
| Example 7 | TA-7 | 130 | 195 | 0/9 | 26 |
| Example 8 | TA-8 | 135 | 190 | 0/9 | 24 |
| Example 9 | TA-9 | 145 | 185 | 0/9 | 26 |
| Example 10 | TA-10 | 145 | 185 | 0/9 | 26 |
| Comparative example 1 | TB-1 | 125 | 180 | 2/9 | 22 |
| Comparative example 2 | TB-2 | 150 | 205 | 0/9 | 26 |
| Comparative example 3 | TB-3 | 155 | 190 | 0/9 | 24 |
| Comparative example 4 | TB-4 | 120 | 175 | 0/9 | 29 |
| Comparative example 5 | TB-5 | 140 | 180 | 2/9 | 26 |
| Comparative example 6 | TB-6 | 125 | 180 | 2/9 | 24 |
| Comparative example 7 | TB-7 | 130 | 180 | 1/9 | 26 |
| Comparative example 8 | TB-8 | 135 | 180 | 3/9 | 24 |
| Comparative example 9 | TB-9 | 130 | 175 | 4/9 | 27 |
| Comparative example 10 | TB-10 | — | — | — | 35 |

Each of the toners TA-1 to TA-10 (the toners according to Examples 1 to 10) had the above-described basic features. Specifically, toner particles of each of the toners TA-1 to TA-10 contained a non-crystalline polyester resin, a crystalline polyester resin, a styrene-acrylic acid-based resin, and a releasing agent (see Table 1). An amount of the releasing agent contained in the toner was at least 7.5% by mass and no greater than 12.5% by mass (see Table 1). For example, an amount of the releasing agent contained in the toner TA-1 was 10.0% by mass. An amount of the styrene-acrylic acid-based resin contained in the toner was at least 50 parts by mass and no greater than 100 parts by mass relative to 100 parts by mass of the releasing agent (see Table 1). For example, an amount of the styrene-acrylic acid-based resin contained in the toner TA-1 was 75 parts by mass relative to 100 parts by mass of the releasing agent. Also, an amount of the styrene-acrylic acid-based resin contained in the toner TA-6 was 60 parts by mass (=7.5/12.5) relative to 100 parts by mass of the releasing agent. The crystalline polyester resin included a first repeating unit derived from an acrylic acid-based monomer and a second repeating unit derived from a styrene-based monomer (see Tables 1 and 3). Also, the styrene-acrylic acid-based resin included a third repeating unit derived from an acrylic acid-based monomer that has an epoxy group and a fourth repeating unit derived from a styrene-based monomer. In the GPC molecular weight distribution of the toner, the peak top molecular weight was at least 8,000 and no greater than 12,000, and the mass average molecular weight was at least 40,000 and no greater than 65,000 (see Table 4).

As indicated in Table 5, the toners TA-1 to TA-10 were excellent in all of low-temperature fixability, hot offset resistance, releasability, and pulverizability.

What is claimed is:

1. An electrostatic latent image developing toner comprising a plurality of toner particles each containing a non-crystalline polyester resin, a crystalline polyester resin, a first resin, and a releasing agent, wherein an amount of the releasing agent contained in the toner is at least 7.5% by mass and no greater than 12.5% by mass, an amount of the first resin contained in the toner is at least 50 parts by mass and no greater than 100 parts by mass relative to 100 parts by mass of the releasing agent, the crystalline polyester resin includes a first repeating unit derived from a (meth)acrylic acid monomer or a (meth)acrylate monomer and a second repeating unit derived from a styrene monomer, the first resin is a polymer of monomers including a styrene monomer and either a (meth)acrylic acid monomer or a (meth)acrylate monomer and includes a third repeating unit derived from a (meth)acrylate monomer that has an epoxy group and a fourth repeating unit derived from a styrene monomer, a peak top molecular weight of the toner in a differential molecular weight distribution curve obtained by GPC measurement is at least 8,000 and no greater than 12,000, and a mass average molecular weight of the toner determined by the GPC measurement is at least 40,000 and no greater than 65,000.

2. The electrostatic latent image developing toner according to claim 1, wherein the crystalline polyester resin includes a repeating unit derived from a (meth)acrylic acid monomer, as the first repeating unit, and the first resin further includes a fifth repeating unit derived from a (meth)acrylic acid monomer, in addition to the third repeating unit and the fourth repeating unit.

3. The electrostatic latent image developing toner according to claim 2, wherein the non-crystalline polyester resin has an acid value of at least 10 mgKOH/g and no greater than 30 mgKOH/g.

4. The electrostatic latent image developing toner according to claim 3, wherein the non-crystalline polyester resin has an SP value of at least 12.0 $(cal/cm^3)^{1/2}$ and no greater than 13.0 $(cal/cm^3)^{1/2}$, and the crystalline polyester resin has an SP value of at least 10.0$(cal/cm^3)^{1/2}$ and no greater than 10.6 $(cal/cm^3)^{1/2}$.

5. The electrostatic latent image developing toner according to claim 1, which is a pulverized toner.

6. The electrostatic latent image developing toner according to claim 1, wherein the first resin includes a repeating unit derived from glycidyl (meth)acrylate as the third repeating unit.

7. The electrostatic latent image developing toner according to claim 1, wherein the crystalline polyester resin is a polymer of monomers including at least one α,ω-alkanediol having a carbon number of at least 2 and no greater than 8, at least one unsaturated dicarboxylic acid, a styrene monomer, and at least one (meth)acrylic acid.

8. The electrostatic latent image developing toner according to claim 1, wherein the crystalline polyester resin is a polymer of monomers including at least one α,ω-alkanediol having a carbon number of at least 2 and no greater than 8, at least one α,ω-alkane dicarboxylic acid having a carbon number of at least 4 and no greater than 10, a styrene monomer, and at least one (meth)acrylic acid.

9. The electrostatic latent image developing toner according to claim 1, wherein the first resin is a polymer of monomers including a styrene monomer, at least one glycidyl (meth)acrylate, at least one (meth)acrylic acid alkyl ester that has an alkyl group having a carbon number of at least 2 and no greater than 8in an ester portion thereof, and at least one (meth)acrylic acid.

10. The electrostatic latent image developing toner according to claim 1, wherein the releasing agent is an ester wax.

* * * * *